US006028298A

United States Patent [19]

Yang

[11] Patent Number: 6,028,298

[45] Date of Patent: Feb. 22, 2000

[54] TURNTABLE DRIVING APPARATUS OF MICROWAVE OVEN AND CONTROL METHOD THEREOF

[75] Inventor: Ha-Yeong Yang, Suwon, Rep. of Korea

[73] Assignee: Samsung Electronics Co., Ltd., Suwon, Rep. of Korea

[21] Appl. No.: 08/729,377

[22] Filed: Oct. 17, 1996

[30] Foreign Application Priority Data

Oct. 27, 1995 [KR] Rep. of Korea ..... 95-37630

[51] Int. Cl.[7] ..... H05B 6/78

[52] U.S. Cl. ..... 219/753; 219/762; 219/704; 108/20; 99/443 R; 126/338

[58] Field of Search ..... 219/753, 752, 219/754, 762, 763, 704–706; 108/20, 139, 138; 126/338; 99/443 R

[56] References Cited

U.S. PATENT DOCUMENTS

| | | | |
|---|---|---|---|
| 3,436,506 | 4/1969 | Smith | 219/753 |
| 3,566,066 | 2/1971 | Borthwick et al | 219/753 |
| 3,745,291 | 7/1973 | Peterson et al. | 219/753 |
| 4,652,712 | 3/1987 | Zeipel | 219/753 |
| 4,752,276 | 6/1988 | Fukumoto | 219/754 |
| 4,757,173 | 7/1988 | Park | 219/753 |
| 4,783,582 | 11/1988 | Wada et al. | 219/762 |
| 5,192,842 | 3/1993 | Kim | 219/753 |

*Primary Examiner*—Philip H. Leung
*Attorney, Agent, or Firm*—Burns, Doane, Swecker, Mathis, L.L.P.

[57] ABSTRACT

A microwave oven includes a turntable disposed in a cooking chamber. The turntable is seated on rollers which are driven about horizontal axes to rotate the turntable. The rollers are mounted on elements that can be raised and lowered, whereby the turntable is raised and lowered while being rotated. A drive mechanism which raises and lowers the rollers is reversible whereby the turntable is rotated in a first direction while being raised, and in a second direction while being lowered. Position detectors sense when the turntable has reached maximum upper and lower positions for reversing the drive mechanism.

9 Claims, 9 Drawing Sheets

TURNTABLE DRIVING APPARATUS OF MICROWAVE OVEN AND CONTROL METHOD THEREOF

BACKGROUND OF THE INVENTION

1. Field of the invention

The present invention relates to a microwave oven and a control method thereof and more particularly to a turntable driving apparatus of a microwave oven and a control method thereof by which a turntable can be moved vertically.

2. Description of the Prior Art

Generally, when a cooking information is established by a user through key input means in order to cook the food 106 placed on a turntable 104 of a prior art microwave oven (see FIG. 8), the cooking information is input to control means (not shown), and high frequency waves are generated by high frequency generating means (not shown) according to control of the control means to thereby cook the food 106.

In the conventional microwave oven thus constructed, the turntable is rotated about a vertical axis while the food is cooked by high frequency.

However, there is left room for improvement in the conventional microwave oven in that, because the high frequency is infused into an upper area of a cooking chamber through a wave guide to be directly radiated to the food or indirectly radiated as a result of reflections from a wall surface in the cooking chamber, the cooking time cannot be shortened and cooking efficiency cannot be improved either, due to the relatively small quantity of high frequency which is actually radiated directly to the food.

SUMMARY OF THE INVENTION

Accordingly, the present invention is provided to solve the aforementioned problems and it is an object of the present invention to provide a turntable driving apparatus of a microwave oven and a control method thereof by which a turntable on which the food is to be placed can be moved horizontally as well as vertically, so that the high frequency can be evenly dispersed on the food during the cooking process to thereby shorten the cooking time and to improve cooking efficiency at the same time.

In accordance with one aspect of the present invention, there is provided a turntable driving apparatus of a microwave oven having a turntable for placing a to-be-cooked food thereon, key input means for establishing a cooking information for cooking the food, control means for controlling an overall operation in order to cook the food according to the established cooking information and high frequency generating means for generating the high frequency according to control of the control means in order to cook the food, the apparatus comprising; turntable driving means for moving the turntable horizontally and vertically according to the control of the control means so that the high frequency generated from the high frequency generating means can be evenly dispersed and radiated to the food; and position detecting means for detecting a position of the turntable so that the turntable can be repeatedly moved vertically and for outputting a signal detected therefrom to the control means.

In accordance with another aspect of the present invention, there is provided a control method of a microwave oven, the method comprising the steps of;

establishing a cooking information in order to cook the food disposed on the turntable and generating the high frequency for heating the food according to the cooking information established therein to thereby radiate same to the food (first step);

horizontally rotating the turntable so that the food can be evenly radiated with the high frequency, and, at the same time, raising the turntable to a maximum allowable upper position (second step);

horizontally rotating the turntable so that the food can be evenly radiated with the high frequency, and, at the same time, lowering the turntable to a maximum allowable lower position (third step); and repeating the raising and lowering of the turntable to the maximum allowable upper and lower positions thereof during the cooking time established at the first step to thereby cook the food (fourth step).

BRIEF DESCRIPTION OF THE DRAWINGS

For a fuller understanding of the nature and objects of the invention, reference should be made to the following detailed description taken in conjunction with the accompanying drawings in which:

FIG. 4A shows a sectional view for illustrating an element which supports the turntable, in FIG. 1, FIG. 4B schematic diagram for illustrating a top view of the element depicted in FIG. 4A, and FIG. 4C is a schematic diagram for illustrating a side view of the element depicted in FIG. 4A;

DETAILED DESCRIPTION OF A PREFERRED EMBODIMENT OF THE INVENTION

The preferred embodiment of the present invention will now be described in detail with reference to the accompanying drawings.

Figure 1:
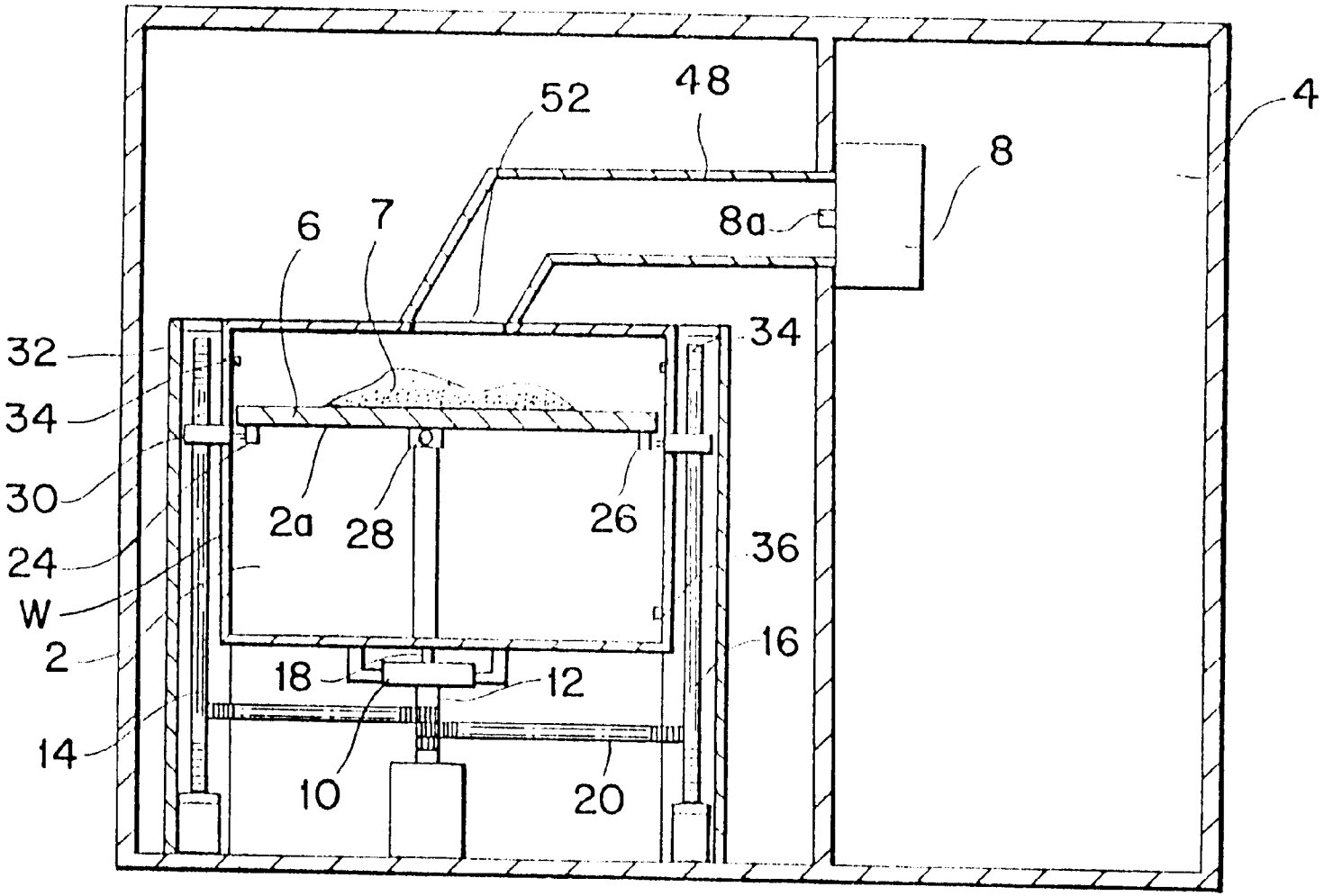
FIG. 1 is a front sectional view of a microwave oven according to the preferred embodiment of the present invention.
Figure 2:
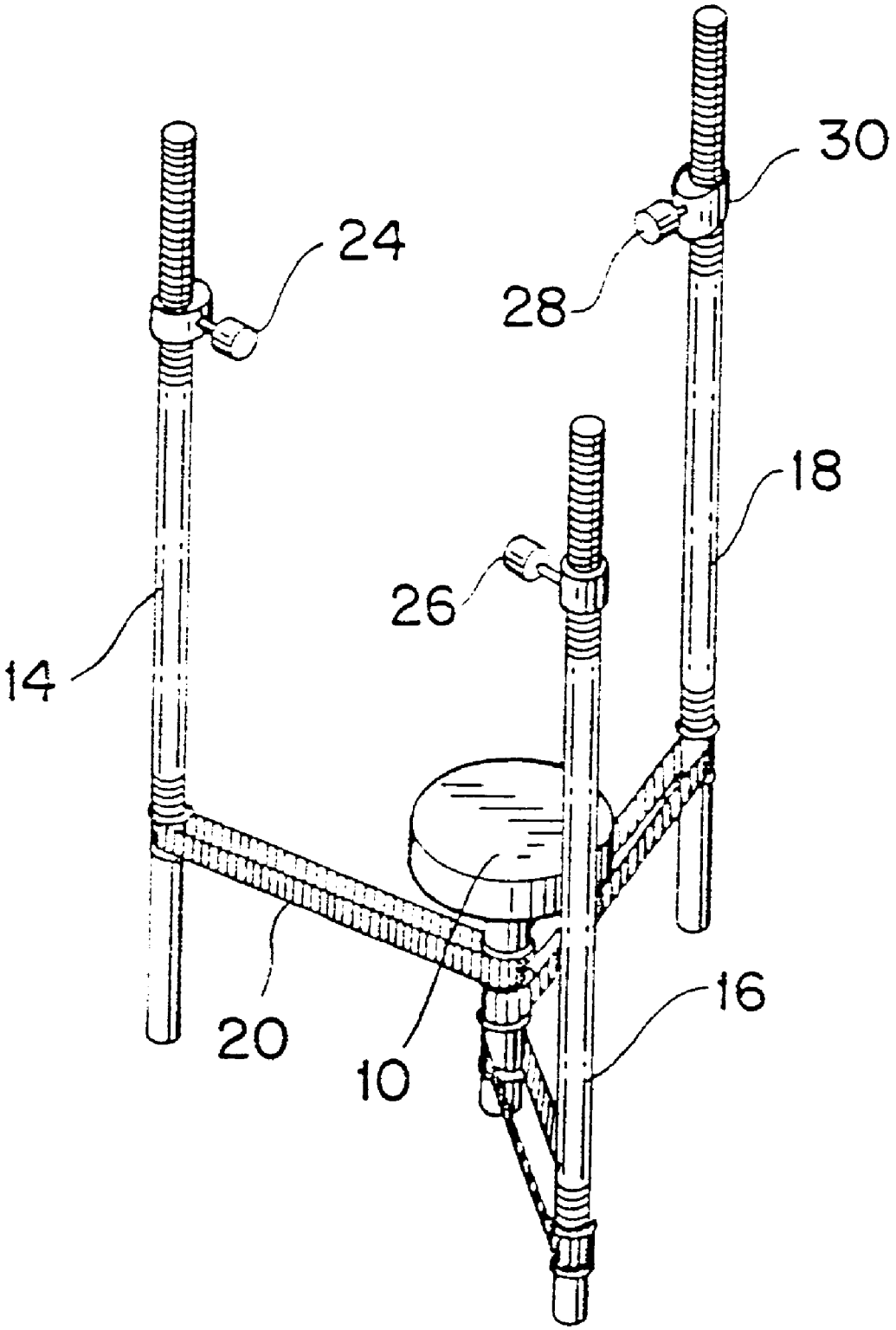
FIG. 2 is a perspective view of a motor and an axis for horizontally rotating and vertically moving a turntable of the microwave oven in FIG. 1.
Figure 3:
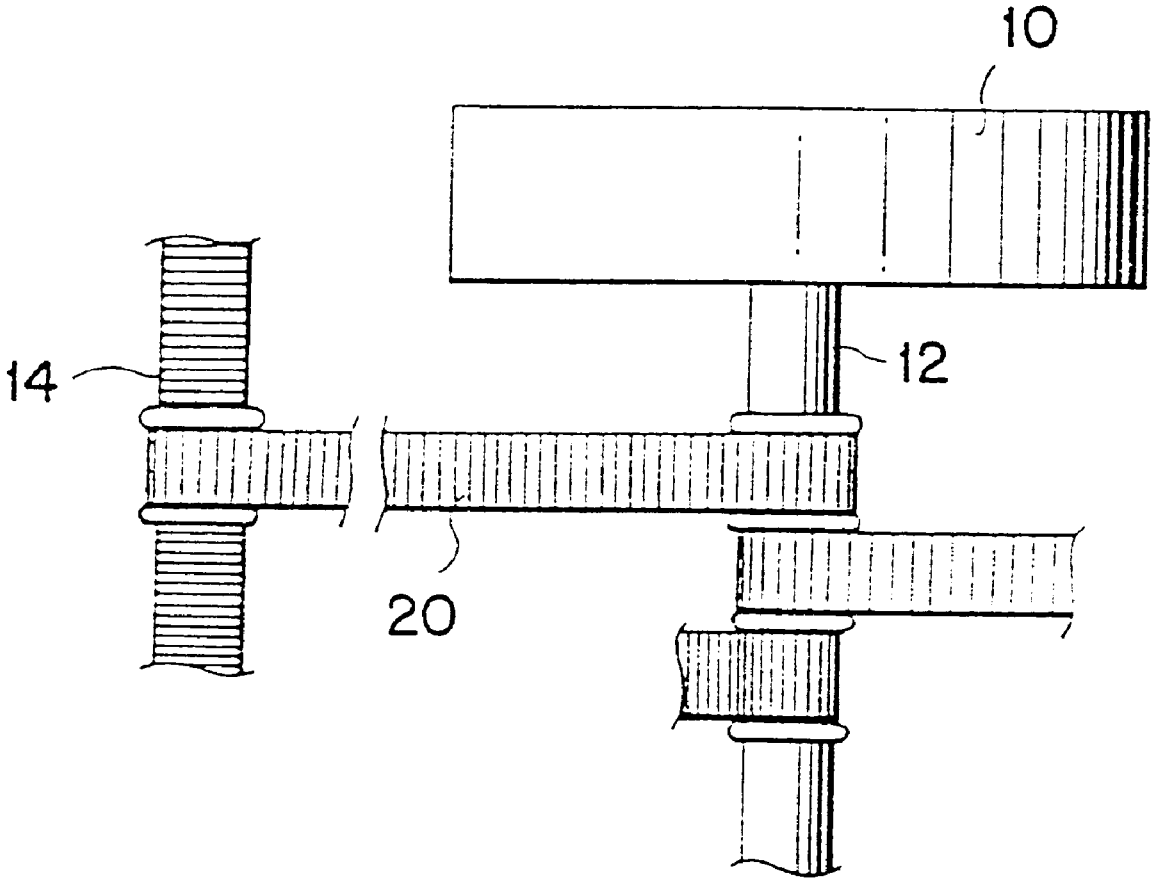
FIG. 3 is a fragmental view for illustrating a coupled state of a main axle, a belt and an auxiliary axle.

Referring to FIGS. 1, 2 and 3, there is disposed a magnetron 8 in a control chamber 4 at a right side of a cooking chamber 2 on the drawings for generating high frequency according to a control signal output from control means (described later) so as to cook the food laid on a turntable 6.

Beneath the cooking chamber 2 is a motor 10 driven or rotated by voltage output from motor driving means (described later)

The motor 10 is coupled thereunder to a main axle 12 so as to be integrally rotated with a rotary axle thereof.

The main axle 12 is connected to auxiliary axles 14, 16 and 18 through the medium of belts 20 for being rotated and at the same time for being vertically moved according to rotation of the main axle 12 so that the turntable 6 can be vertically moved.

The three auxiliary axles 14, 16 and 18 are respectively disposed in respective inner walls of the cooking chamber 2 so as to support the turntable 6.

Furthermore, the auxiliary axles 14, 16 and 18 are formed at certain areas thereof with a screw thread.

Figure 4A:
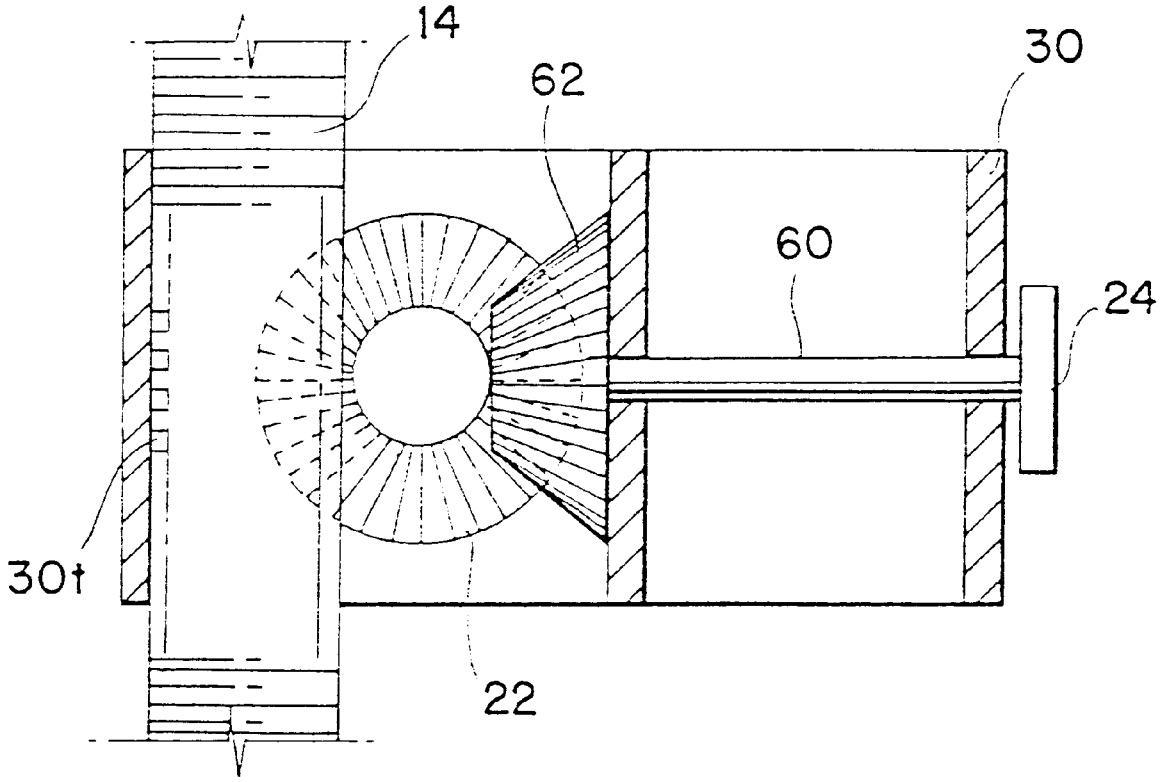
FIGS. 4A, 4B and 4C are schematic diagrams where
Figure 4B:
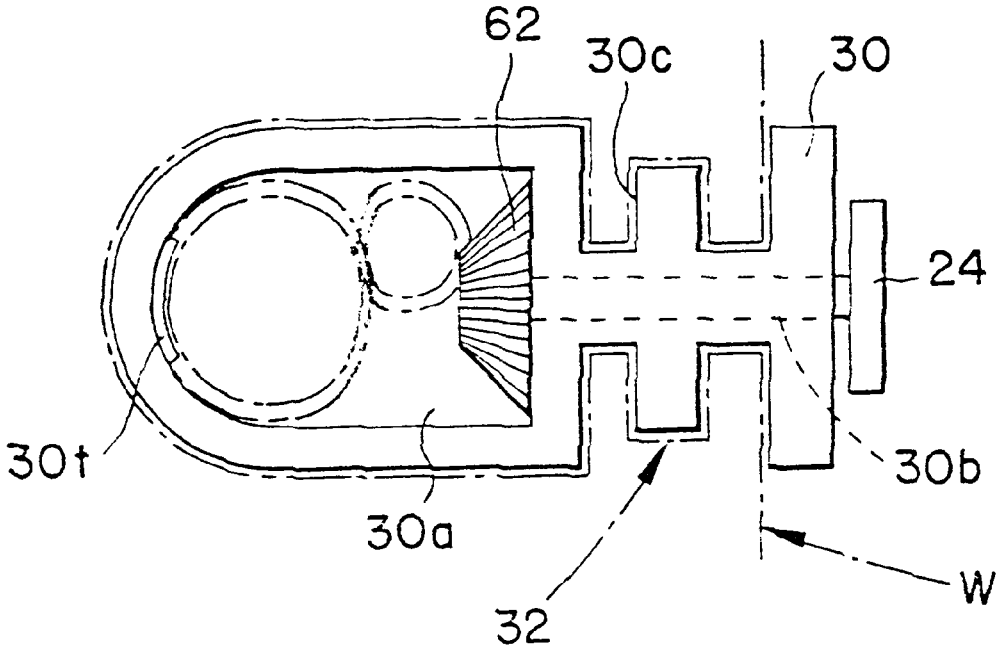
Figure 4C:
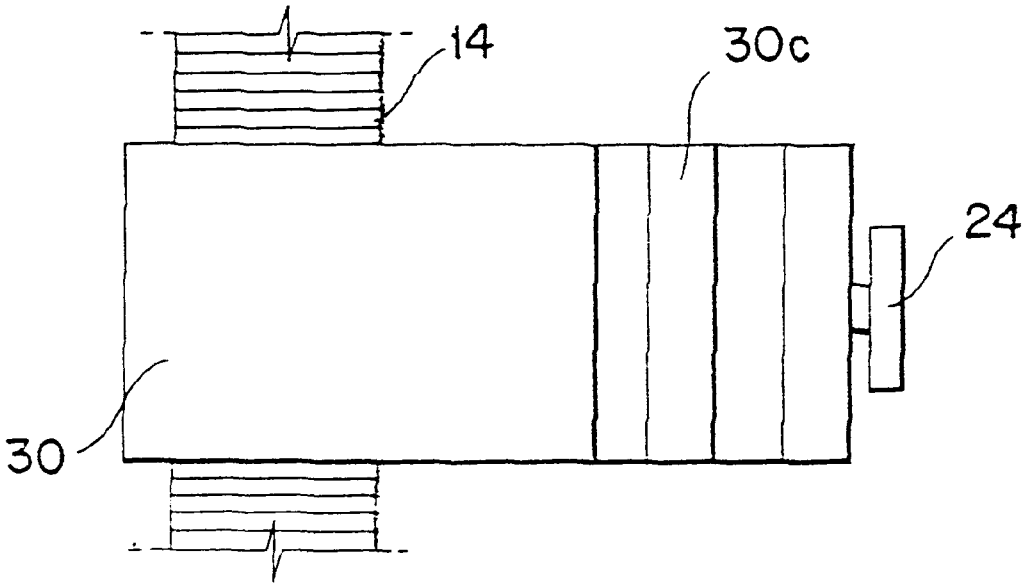

The auxiliary axles 14, 16 and 18, as illustrated in FIGS. 4A, 4B and 4C are respectively coupled to rollers 24, 26 and 28 through rotary gears 22 formed in a bevel gear shape for rotating the rollers about respective horizontal axes.

The turntable 6 is seated on the rollers 24, 26 and 28 so as to be moved vertically therewith, and to be rotated thereby as will be explained.

The auxiliary is disposed therearound with axles each carrying a fixing member 30 on which are mounted the rollers 24, 26 and 28 and the rotary gears direction.

Meanwhile, the rollers 24, 26 and 28 are fixed on respective shafts 60 each of which extends through a hole 30*b* of a fixing member 30. A gear 62 is fixed to the shaft 60 and is coupled to the rotary gears 22 so as to be rotated according to rotation of the gear 22.

Furthermore, the fixing member 30 is formed at an external surface thereof with an irregular profile 30*c* so as to be slidably mounted in a second fixing member 32 (described later).

Figure 5:
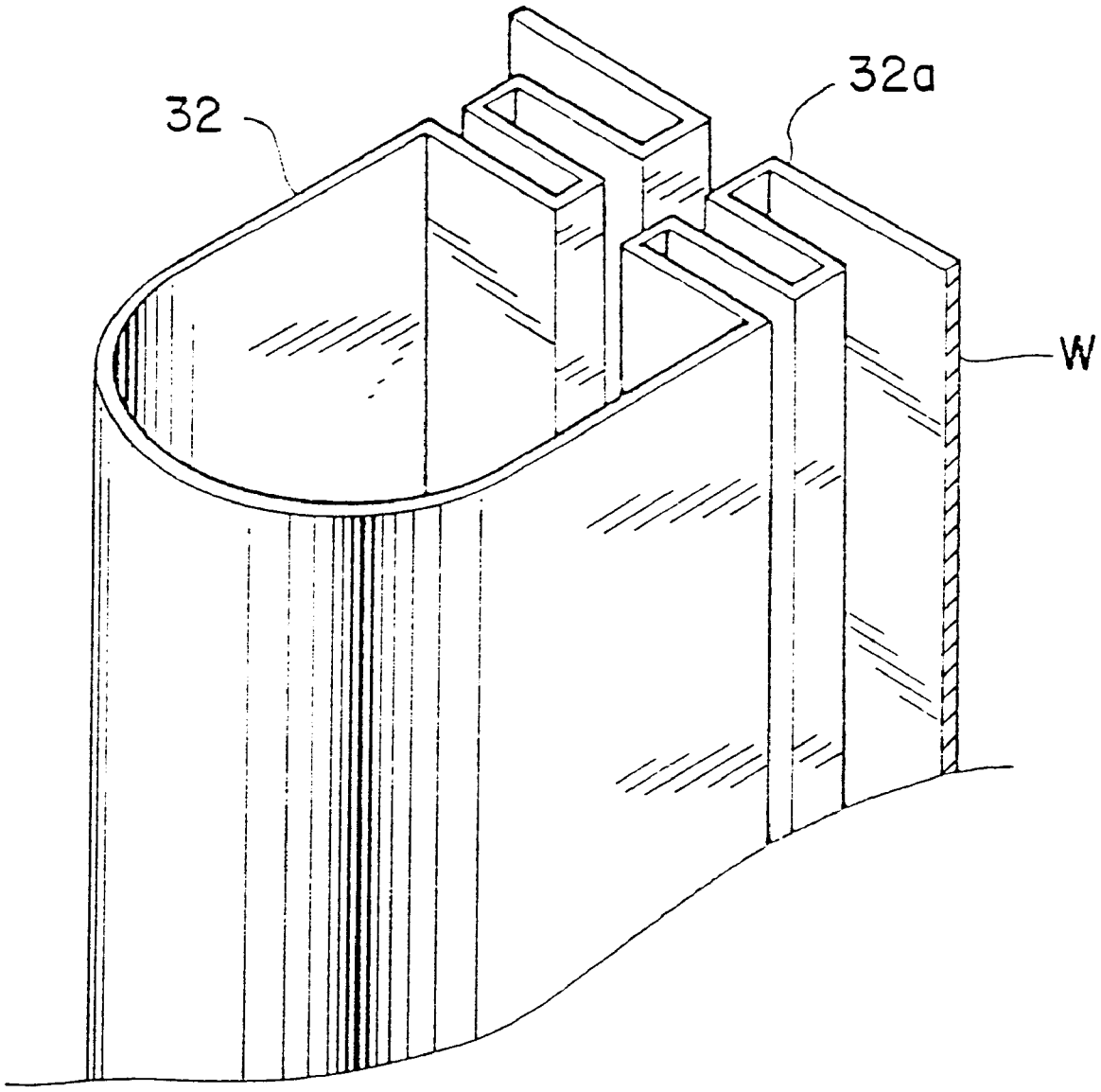
FIG. 5 is a perspective view of a fixing member depicted in FIG. 1.

As illustrated in FIG. 5, the second fixing member 32 is integral with a wall W of the cooking chamber 2 and is formed with a second irregular profile 32*a* for being coupled to the profile 30*c* of the fixing member 30 so as to vertically guide the fixing member 30.

The second fixing member 32 is formed in a duct shape in order to vertically guide the fixing member 30.

Now, back to FIG. 1, the cooking chamber 2 is provided at a left side and at a right side thereof with first position detecting means 34 such as an optical sensor for detecting whether the turntable 6 has ascended to a maximum allowable upper position established to prevent same from hitting a ceiling plate 2*a* of the cooking chamber.

Furthermore, the cooking chamber 2 is provided at predetermined positions thereof with second position detecting means such as a micro switch for detecting whether the turntable 6 has descended to a maximum allowable lower position established to prevent same from excessively descending downwards to thereby generate problems.

The first and second position detecting means 34 and 36 serve to output a signal to control means (described later).

Figure 6:
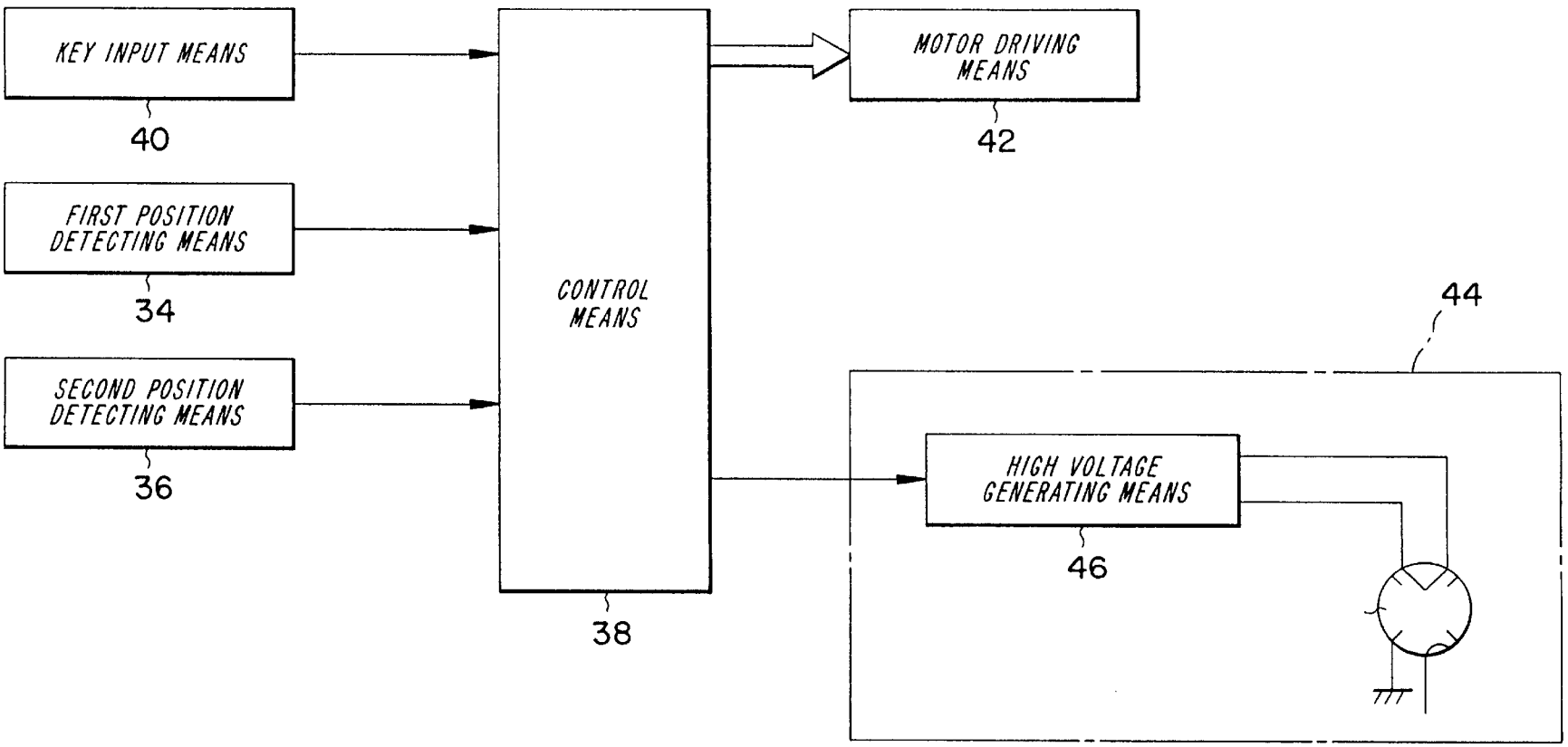
FIG. 6 is a control block diagram of a microwave oven according to the preferred embodiment of the present invention.

Now, FIG. 6 is to be described which is a control block diagram of a microwave oven according to the preferred embodiment of the present invention.

Control means 38 in the drawing is a microcomputer for controlling a food cooking operation of the microwave oven according to the preferred embodiment of the present invention and for controlling rotation and vertical movement operations of the turntable 6.

Key input means 40 serves to establish a cooking information necessary for cooking wanted by a user, and the cooking information established therein is input to the control means 38.

The first position detecting means 34 serves to detect whether the turntable 6 has reached the maximum allowable upper position and output a signal to the control means 38.

The second position detecting means 36 serves to detect whether the turntable 6 has descended to the maximum allowable lower position and output a signal to the control means 38.

Motor driving means 42 serves to drive the motor 10 according to the control signal output from the control means 38 so that the turntable 6 can be rotated and vertically moved.

The motor driving means 42, motor 10, main axle 12, auxiliary axles 14, 16 and 18, and the rollers 24, 26 and 28 constitute turntable driving means for rotating and vertically moving the turntable 6 according to the control signal output from the control means 38, so that the high frequency generated from the magnetron 8 can be dispersed and radiated to the food.

High frequency generating means 44 for generating high frequency according to the control signal output from the control means to cook the food placed on the turntable 6 is the magnetron 8, which is oscillated by high voltage generating means 46 for generating high voltage according to the control signal output from the control means 38.

Figure 7:
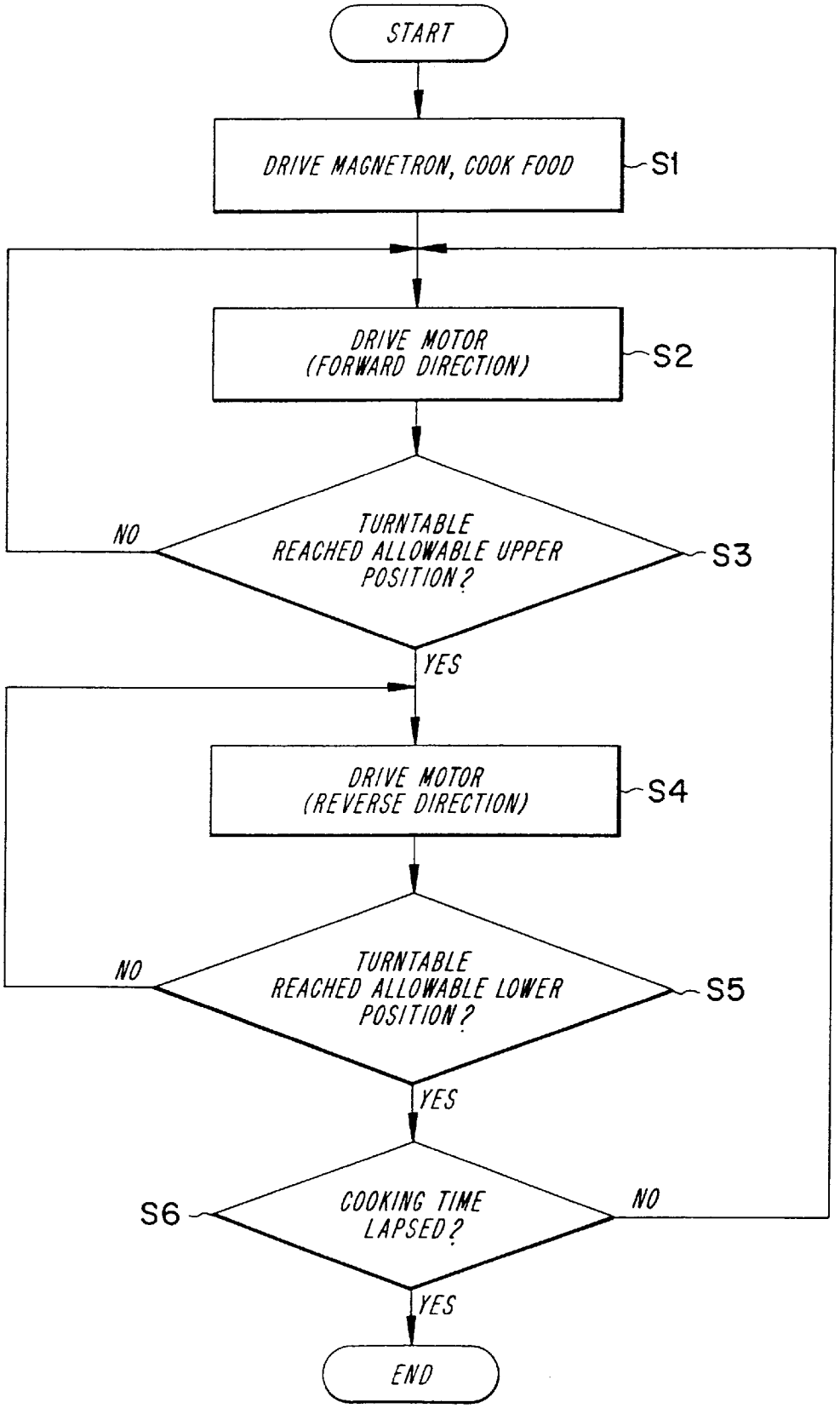
FIG. 7 is a flow chart of a control method of the microwave oven according to the preferred embodiment of the present invention.
Figure 8:
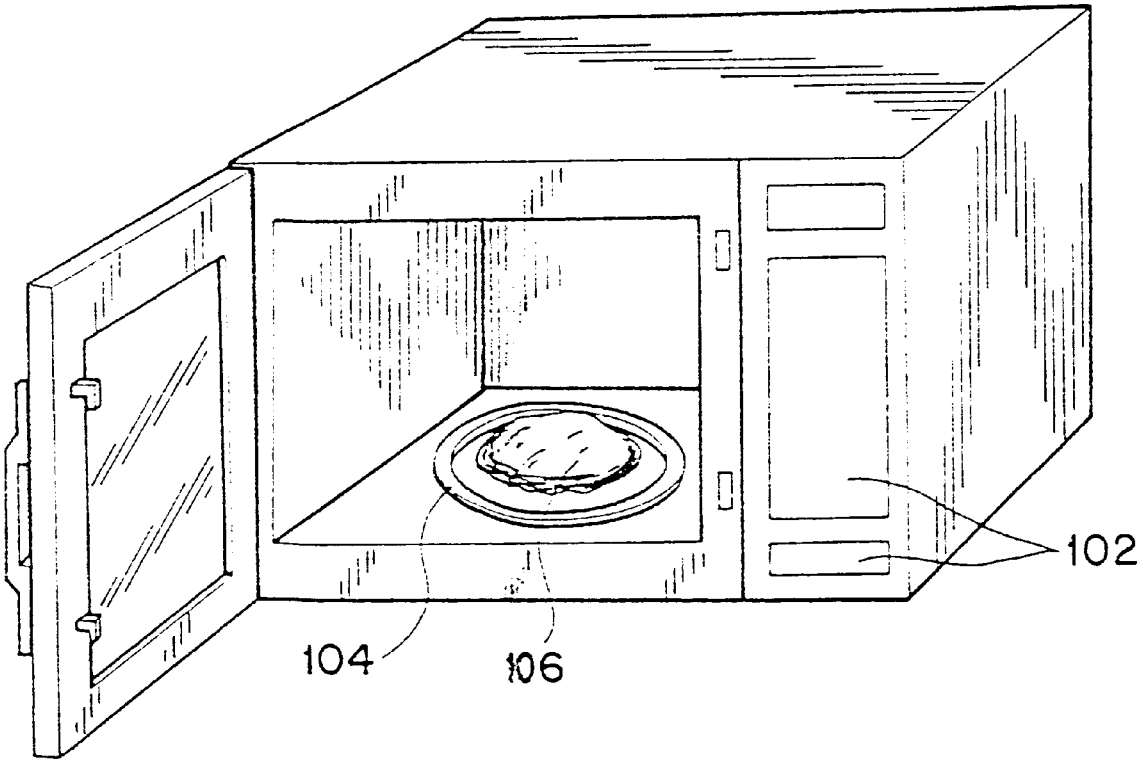
FIG. 8 (PRIOR ART)
FIG. 8 is an external perspective view of a microwave oven according to the prior art.

Hereinafter, a control method of the turntable driving apparatus of a microwave oven according to the preferred embodiment of the present invention thus constructed will be described with reference to FIG. 7.

First of all, at step S1, the user places the food 7 to be cooked on the turntable 6.

Successively, the user inputs such cooking information of the food 7 as cooking temperature, cooking time and cooking operation commencing order through the key input means 40.

Subsequently, the cooking temperature, cooking time and cooking operation commencing order are output to the control means 38 from the key input means 40.

The control means 38 having received the cooking information serves to output a control signal to generate a high voltage for driving the magnetron 8 and outputs same to the high voltage generating means 46.

The high voltage generating means 46 in turn generates a predetermined value, for example a direct voltage of 4,000 V, according to the control signal to supply same to the magnetron 8 and to thereby activate the magnetron 8. Subsequently, the high frequency generated from the magnetron 8 is output through an antenna 8*a* to thereby flow in the waveguide 48.

The high frequency is then radiated through holes 52 to the food 7 placed on the turntable 6.

Next, at step S2, a control signal is generated from the control means 38 to the motor driving means 42 in order to drive the motor 10 in a forward direction.

Accordingly, the motor driving means 42 applies a driving voltage to the motor 10 to thereby drive the motor in the forward direction.

According to the forward rotation of the motor 10, the main axle 12 coupled to a rotary axle of the motor 10 is rotated in a forward direction, and the turning effect of the main axle 12 is transmitted to the auxiliary axles 14, 16 and 18 through the medium of the belts 20 to thereby rotate the auxiliary axles 14, 16 and 18 in the forward direction.

Simultaneously, the rotary gear 22 is rotated in the forward direction, i.e., clockwise direction.

At this time, because a marginal area of the fixing member 30 and the auxiliary axles 14, 16 and 18 are coupled together, e.g., by the external screw thread of the axles 14,16, 18 and the internal screw teeth 30*t* of the fixing member 30, when the auxiliary axles 14, 16 and 18 are rotated, the fixing member 30 is moved upward.

Simultaneously, rollers 24, 26 and 28 and the turntable 6 rise.

Meanwhile, because the rotary gear 22 is rotated in a forward direction, the rollers 24, 26 and 28 are also forwardly rotated.

Simultaneously, the turntable 6 on the rollers 24, 26 and 28 is forwardly rotated.

As mentioned in the above, while the turntable 6 is forwardly rotated in horizontal direction and vertically moved, the high frequency radiated into the cooking chamber 2 through the holes 52 is evenly dispersed to the food 7 placed on the turntable 6 and the food is accordingly cooked.

Next, at step S3, a discrimination is made as to whether or not the turntable 6 has ascended to the maximum allowable upper position.

The position of the turntable 6 is discriminated by the control means 38 according to the signal detected by the first position detecting means 34.

As a result of the discrimination, if the turntable 6 has not reached the maximum allowable upper position (in case of No), operation of step S2 is repeatedly performed to thereby allow the turntable 6 to keep ascending.

Meanwhile, as a result of the discrimination at step S3, if the turntable 6 has reached the maximum allowable upper position (in case of YES), flow proceeds to step S4.

In other words, at step S4, a control signal is generated from the control means 38 to the motor driving means 42 for reversely driving the motor 10.

Subsequently, the motor driving means 42 serves to apply voltage to the motor 10 to reversely drive the motor 10.

According to the reverse rotation of the motor 10, the main axle 12 coupled to a rotary axle of the motor 10 is reversely rotated, and a turning effect of the main axle 12 is transmitted to the auxiliary axles 14, 16 and 18 through the medium of the belt 20, and the auxiliary axles 14, 16 and 18 are reversely rotated.

Accordingly, the rotary gears 22 is rotated counterclockwise.

At this time, because a marginal area of the fixing member 30 and the auxiliary axles 14, 16 and 18 are coupled together, the fixing member 30 descends according to the rotation of the auxiliary axles, 14, 16 and 18.

At the same time, the rollers 24, 26 and 28 and the turntable 6 descend are.

Meanwhile, because the rotary gears 22 are rotated reversely, the rollers 24, 26 and 28 are also rotated reversely.

Subsequently, the turntable 6 is reversely rotated and descends vertically, while the high frequency radiated into the cooking chamber 2 through the holes 52 is evenly dispersed to the food placed on the turntable 6 and the cooking thereof is executed.

Next, at step S5, a discrimination is made as to whether or not the turntable 6 has kept descending to thereby reach the maximum allowable lower position.

The position of the turntable 6 is discriminated by the control means 38 according to the signal detected by the second position detecting means 36.

As a result of the discrimination, if the turntable 6 has not reached the maximum allowable lower position (in case of No), operation of step S4 is repeatedly performed to thereby allow the turntable 6 to keep descending.

Meanwhile, as the result of the discrimination at step S5, if the turntable 6 has reached the maximum allowable lower position (in case of YES), flow advances to step S6.

In other words, a discrimination is made at step S6 as to whether or not the cooking time supplied from the key input means 40 to the control means 38 at step S1 has lapsed, which can be possible by a timer inherently disposed in the control means.

In other words, a discrimination is made as to whether the magnetron 8 has to be kept running.

As a result of the discrimination, if it is discriminated that the cooking time has lapsed (in case of YES), control means 38 outputs control signals for stopping the high voltage generating means 46 and the motor driving means 42 respectively.

Subsequently, the high voltage generating means 46 is caused to generate the high voltage no longer.

At the same time, the motor driving means 42 serves to stop driving the motor 10.

Successively, the main axle 12, auxiliary axles 14, 16 and 18, rotary gear 22 and the rollers 24, 26 and 28 are sequentially stopped and rotation and vertical movement of the turntable 6 are also stopped.

Meanwhile, as a result of the discrimination at step S6, if it is discriminated that the cooking time input to the control means 38 from the key input means 40 at step S1 has not lapsed so that the magnetron 8 has to be kept running(in case of NO), flow returns to step S2 and the turntable 6 is caused to continue the rotation and vertical movement, in other words, ascent and descent of the turntable are repeated to thereby cook the food.

Meanwhile, although in the preferred embodiment of the present invention the cooking time of the food is established through the key input means 40, it should be noted that if a the weight sensor for detecting weight of the turntable 6 can be disposed at a predetermined position, i,e., around the second position detecting means 36, the weight of the food 7 can be discriminated by the control means 38 and optimum cooking time and the like can be calculated by the control means 38 according to the weight of the food 7, whereby the turntable 6 can be rotated and vertically moved during the calculated cooking time to thereby cook the food 7.

As is apparent from the foregoing, there is an advantage in the turntable driving apparatus of a microwave oven and a method thereof, in that a turntable can be not only rotated during cooking of the food but can be vertically moved, so that the food on the turntable can be treated evenly with high frequency waves to thereby improve a cooking efficiency and to accurately cook the food according to the intention of the user.

What is claimed is:

1. A microwave oven comprising:

a casing forming a cooking chamber;

a high frequency generator for generating high frequency waves supplied to the cooking chamber;

a turntable disposed in the cooking chamber for supporting food to be cooked;

a reversible drive mechanism operably connected to the turntable for rotating the turntable about a vertical axle while simultaneously moving the turntable up and down during the supplying of high frequency waves to the cooking chamber; and position detectors for detecting the turntable in uppermost and lowermost positions thereof and being connected to the drive mechanism for reversing the drive mechanism to raise the turntable in response to reaching its lowermost position, and lowered in response to reaching its uppermost position.

2. The microwave oven according to claim 1 wherein the drive mechanism comprises: a plurality of upright axles rotatable about respective vertical axles; elements being mounted on respective ones of the axles to be raised and lowered in response to rotation of the axles in first and second directions, respectively, each of the elements carrying a roller rotatable about a horizontal axle; the turntable being seated upon the rollers; a motor for rotating the axles to raise and lower the elements; and a motion transmitting mechanism disposed on each element for transmitting rotation of the respective axle to the respective roller for rotating the roller in response to the axle being rotated, whereby the turntable is rotated while being raised and lowered.

3. The microwave oven according to claim 2 wherein the motion transmitting mechanisms are operable to rotate the rollers in a first direction while the turntable is being raised, and in a second direction while the turntable is being lowered.

4. The microwave oven according to claim 2, further including a shaft driven by the motor, and belts interconnecting the shaft with respective ones of the axles for rotating the axles.

5. The microwave oven according to claim 1 wherein each of the axles includes external screw threading; the motion transmitting mechanism comprising a gear mounted on the element and meshing with the screw threading, the gear being connected to a respective roller.

6. The microwave oven according to claim 5 wherein the gear is a bevel gear.

7. The microwave oven according to claim 1 wherein the position detectors include an upper position detector for detecting the turntable at its maximum upper position, and a lower position detector for detecting the turntable at its maximum lower position.

8. The microwave oven according to claim 7 wherein the upper position detector comprises an optical sensor, and the lower position detector comprises a microswitch.

9. A method of operating a microwave oven, comprising the steps of:

A) generating microwaves and guiding the microwaves to a cooking chamber;

B) supporting food on a turntable disposed in the cooking chamber;

C) rotating the turntable about a vertical axle during step A; and

D) repeatedly raising and lowering the turntable between upper and lower positions during step C by operating a reversible drive mechanism in a first direction to raise the turntable to the upper position at which an upper position detector is actuated to reverse the drive mechanism for operation in a second direction to lower the turntable to the lower position at which a lower position detector is actuated for causing the drive mechanism to operate in the first direction.

* * * * *